United States Patent [19]

Bernhard

[11] 3,977,823

[45] Aug. 31, 1976

[54] METHOD OF BURNING RESIDUAL FUEL OIL IN DISTILLATE FUEL OIL BURNERS

[76] Inventor: Frank Bernhard, 11936 Claychester Drive, St. Louis, Mo. 63131

[22] Filed: July 2, 1975

[21] Appl. No.: 592,781

[52] U.S. Cl. ..... 431/11; 431/41; 431/166; 431/208; 431/212

[51] Int. Cl.[2] ..... F23D 11/44; F23L 15/00

[58] Field of Search ..... 431/11, 166, 161, 207, 431/212, 216, 36, 41, 208

[56] References Cited

UNITED STATES PATENTS

| | | | |
|---|---|---|---|
| 1,473,657 | 11/1923 | Wiederwax | 431/212 |
| 1,987,401 | 1/1935 | Hillhouse | 431/11 |
| 2,625,211 | 1/1953 | Hill | 431/41 |
| 3,897,200 | 7/1975 | Childree | 431/166 X |

*Primary Examiner*—Edward G. Favors
*Attorney, Agent, or Firm*—Henry W. Cummings

[57] ABSTRACT

This invention comprises a method whereby heated residual fuel oils can be successfully burned in existing conventional forced atomizing air type small capacity industrial oil burners.

15 Claims, 5 Drawing Figures

METHOD OF BURNING RESIDUAL FUEL OIL IN DISTILLATE FUEL OIL BURNERS

BACKGROUND OF THE INVENTION

Residual fuel oil may be defined as "the remaining heavy portion of crude oil after fractional distillation and cracking have taken place, with the viscosity of such residuum (which may be a blend) being higher than about 100 to 150 SSU (Saybolt Seconds Universal) at a temperature of 100°F".

Conventional industrial distillate fuel oil burners, using forced atomizing air at ambient temperature, are not currently able to successfully burn residual fuel oil, even though such residual fuel oil, just prior to entering the burner, has been preheated to a temperature which results in a viscosity of 100 SSU of such residual fuel oil entering the burner.

It has been stated by many manufacturers of industrial forced atomizing ambient temperature air type fuel oil burners that their small capacity (maximum of approximately 10 gallons per hour) models of such type fuel oil burners will successfully burn only distillate oil, and that residual fuel oil, even though preheated to enter such small capacity oil burners at an oil viscosity of 100 to 150 SSU, cannot be successfully burned in small capacity burners.

Preheating residual oil to a higher temperature (than that required to reduce oil viscosity to 100 to 150 SSU) causes undesirable cracking and carbonization of the oil.

Furthermore, previous burner hot air constructions for burning residual oil usually cannot avoid initial unsuccessful combustion (when initial ignition of the residual fuel oil takes place) because of incomplete atomization and/or vaporization of the initial flow of residual fuel oil through the burner, until a heat exchanger inside or external to the burner has elevated the entering ambient temperature oil or forced atomizing and/or combustion air up to a burner internal heated air temperature adequate to elevate and/or maintain residual fuel oil flowing through the burner at a temperature at which the oil viscosity is reduced sufficiently to allow successful atomization by forced hot air pressure, with subsequent oil vaporization.

U.S. Pat. No. 2,219,917 (Oct. 29, 1940), hereby incorporated into this application by reference, describes a fuel oil burner for burning "heavy" (a residual) oil, by preheating part of the combustion air with gas by means of a Bunsen burner 25. The intended purpose of heated air is to heat such incoming heavy oil inside the burner, elevate oil temperature and reduce oil viscosity inside the burner, with such preheated air surrounding the burner oil flow tube 10 for the greater portion (but not the entire length) of the oil flow tube 10 inside the burner.

However, U.S. Pat. No. 2,219,917 cannot, to my best knowledge and belief, function as described. Its blower 16 supplies ambient temperature forced air (under positive pressure) exterior to the annular heating chamber 12 of the burner. Such ambient temperature forced air pressure in its air duct 13, supplied from blower 16, prevents flow of any preheated air from heating chamber 12 outward through annular orifices 27, inasmuch as there is no incoming air pressure which is higher than blower 16 air pressure. The forced ambient temperature air in air duct 13 will instead force air in duct 13 into heating chamber 12 through the annular orifices 27.

It is believed that this ambient temperature air, under pressure from blower 16, will instead exit from the burner at the location of Bunsen gas burner 25. Thus no heated air can ever enter the burner as described in such patent. Thus it is not believed that the preheating of the oil can be accomplished in the manner described in said patent.

SUMMARY OF THE INVENTION

Residual oil, prior to entering a conventional forced atomizing air type of distillate fuel oil burner, is preheated from ambient temperature up to but not exceeding a temperature such that an oil viscosity of about 90 to 150 SSU at the point of oil entry to the burner oil flow tube is obtained. Ambient temperature air for atomizing, prior to entering the burner, is preheated to provide substantially the same air temperature, when entering the burner, as the temperature of the preheated residual oil entering the burner. Preferably the residual oil enters the burner at 90 to 120 SSU viscosity.

The preheated and forced atomizing air is introduced into the burner in concentric relation with the central conduit carrying the preheated residual oil, and is in heat exchange relation with the oil, whereby the oil temperature is maintained until exit from the central conduit at substantially the same temperature at which the oil entered the central conduit. The preheated air then atomizes the heated residual oil, just prior to vaporization and combustion of the residual oil, exterior to the discharge portion of the burner.

If desired, the preheating of the atomizing air may be initiated prior to introducing preheated residual oil into the burner, whereby the temperature of the central oil carrying metal conduit will then shortly elevate to about the same temperature as the temperature of the preheated residual oil which is to enter such central oil carrying conduit, and successful residual oil atomization will then take place effectively at or near the time the oil is initially flowed through the central oil carrying conduit.

Appropriate apparatus for carrying out this process of preheating of atomizing air is also a part of the present invention.

THE DRAWINGS

DETAILED DESCRIPTION

Figure 1:
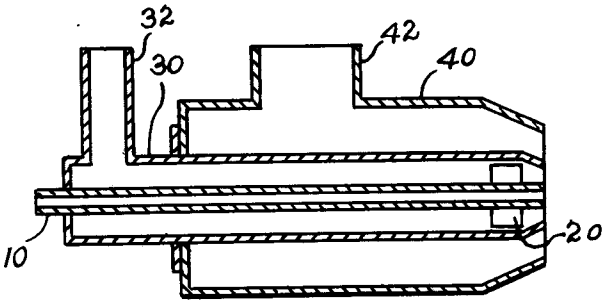
FIG. 1 is a cross-sectional view of a conventional industrial forced air atomizing air type oil burner used with heated atomizing air and heated residual fuel oil, whereby the preheated atomizing air surrounds the oil supply tube carrying the preheated residual oil to the point of oil atomization.

To obtain successful combustion of either distillate or residual fuel oil, forced pressure atomizing air from atomizing air annulus 30, optionally through swirl vanes 20 contacting the fuel oil stream exiting from the oil supply tube 10 of a forced atomizing air type oil burner must change the single stream of exiting fuel oil into a fog of fuel oil droplets or spheres, generally not larger than 10 microns in diameter. The diameter of the oil sphere formed by atomization is a function of the viscosity of the oil being atomized, with lower oil viscosities allowing formation of smaller diameter oil spheres by forced air atomization. Such droplets or spheres of fuel oil are surrounded by air containing oxygen. This intimate mixing of air and no larger than fog size oil spheres is necessary to produce maximum vaporization by heat of such oil spheres (complete vaporization of oil is required for complete combustion).

Forced pressure atomizing air at ambient air temperature in industrial oil burners can successfully atomize distillate fuel oil of 100 to 150 SSU viscosity. However, ambient temperature forced pressure atomizing air, surrounding the oil supply tube of a forced atomizing air type industrial oil burner, will increase the viscosity of a preheated residual oil at 100 to 150 SSU viscosity (after it enters the burner oil supply tube), because of the heat exchange flow away from the heated residual oil to the lower temperature unheated atomizing air (heat exchange taking place the length of the oil supply tube inside the burner). The resultant increased viscosity of the residual fuel oil exiting from the oil supply tube is then substantially higher than 100 to 150 SSU, and the diameter of all oil spheres formed by air pressure atomization is larger than if the residual oil viscosity had remained at 100 to 150 SSU at the residual fuel oil passed through and exited from the oil supply tube.

If a residual fuel oil is heated to a temperature higher than that required for producing a 100 to 150 SSU viscosity of the residual oil (for the purpose of making allowance for an increase in oil viscosity to a final 100 to 150 SSU viscosity as the temperature diminished residual fuel oil exits from the burner temperature diminished oil tube), the residual oil atomization by forced draft ambient air temperature is impaired. Any higher (than necessary for producing 100 to 150 SSU viscosity) oil temperature results in both gasifying of some of the light ends of the fuel oil (which results in either/or flame pulsation and flame instability) and in charring of the heavier ends of the overheated residual fuel oil (depositing carbon on the oil side of the heat transfer surface of the area of the oil preheating, with subsequent restriction of flow of residual fuel oil through such oil heater).

The degree of reduction in fuel oil temperature (because of heat flow outward through the wall of the burner oil supply tube to any unheated lower temperature surrounding atomizing air) is a function of time of duration of oil heat loss as well as temperature differential between heated oil and unheated air. Small capacity forced atomizing air type burners (approximately 10 GPH capacity maximum) generally have an internal diameter of oil supply tube which results in a longer time duration of oil retention in the burner oil supply tube, than the duration of time retention of oil in the oil supply tube of oil burners of higher capacity than approximately 10 GPH. For such reason, the viscosity of heated residual fuel oil exiting from a larger than approximately 10 GPH residual oil burner is generally acceptable, although smaller diameter oil spheres and a higher degree of oil vaporization could be obtained with an oil viscosity not exceeding 100 to 150 SSU, if ambient temperature forced atomizing air surrounding the oil supply tube were replaced by preheated atomizing air.

In accordance with the present invention, by preheating the ambient temperature atomizing air (before it enters the atomizing air entry point of a forced atomizing air type oil burner) to that air temperature which is substantially the same as the temperature of a preheated residual fuel oil entering the burner oil supply tube at a viscosity of 90 to 150 SSU, I am able to successfully burn residual fuel oil in *existing* or *new* type of conventional forced air atomizing type oil burners (including dual fuel burners) heretofore used only for burning distillate fuel oil. Preferably the residual oil is supplied at 90 to 120 SSU. With my invention, I am also able to improve the combustion of residual fuel oil in existing or new type of forced ambient temperature atomizing air type residual oil burners.

The oil preheat temperature which corresponds to a 90 to 150 SSU viscosity for various grades of residual oil is known in the art. For example, a suitable table is found in North American Mfg. Co. pamphlet *Fuel Oils For Industrial Burners*, Handbook Supplement No. 113, January 1975, page 3 thereof. There is also considerably useful background information on fuel oils and burners in the seven page supplement, a copy of which is attached.

With my invention, preheated atomizing air may be initially passed through the atomizing air annulus surrounding a non-flowing oil supply tube of a forced atomizing air type burner for only a short period of time, preferably not more than about 5 minutes. After such initial flow of preheated atomizing air around the metal wall of the burner oil supply tube, the temperature of the wall of the non-flowing metal fuel oil supply tube will have reached substantially the same temperature as the temperature of the preheated 90 to 150 SSU viscosity residual fuel oil to be admitted. The preheated residual oil flow through the heated oil supply tube of the burner can then be started, and generally immediately successful atomization and vaporization of the fuel oil results, because the temperature of the preheated residual oil initial oil flow through the preheated metal oil supply tube will remain substantially constant and not be reduced in temperature or increased in viscosity.

Figure 2:
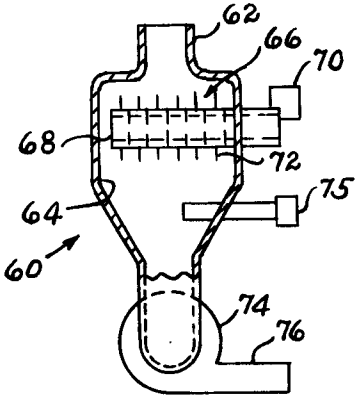
FIG. 2 is a schematic view illustrating an arrangement for preheating the atomizing air.

FIG. 2 illustrates schematically an arrangement for preheating the atomizing air. The air preheating assembly indicated generally at 60 comprises an ambient air inlet 62 to an air preheating chamber 64. Means indicated generally at 66 are provided for heating the ambient air therein. For example, a conduit assembly 68 may be provided for circulating a heat transfer fluid, including but not limited to hot water, steam or hot air, which has been heated higher than the approximate temperature of the preheated residual oil which is to be introduced into the burner. Means for heating the heat transfer medium are illustrated schematically at 70 which may include known electrical, oil, gas, coal heaters and/or direct firing burners. The heating means 70 is conventional. Means indicated at 72 may be provided on conduit 68 for increasing the heat transfer between conduit 68 and the air in chamber 64.

A blower 74 of conventional construction is provided to force the preheated air through appropriate conduit(s) 76 atomizing to air inlet 32 in FIG. 1.

An air temperature sensor 75 may be provided to control the amount/ and/or temperature of the heat transfer fluid from heating means 70, and if desired, also the blower 74. Such automatic control systems are conventional and available on the market.

Figure 2A:
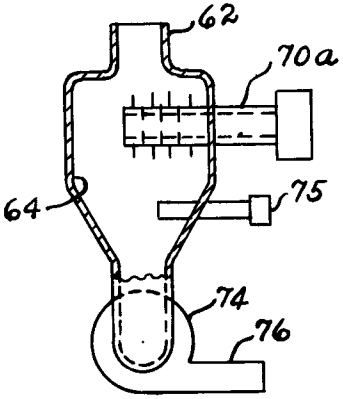
FIG. 2A is a schematic view of an alternate arrangement in which heating means are introduced directly into the air preheating chamber.

FIG. 2A schematically illustrates an alternative in which a heating means 70*a* is inserted directly into preheating chamber 64. Such heating means may include, but not limited to, electric resistance heaters, gas burner or distillate fuel oil burners. The operation is otherwise the same as in FIG. 2.

Figure 3:
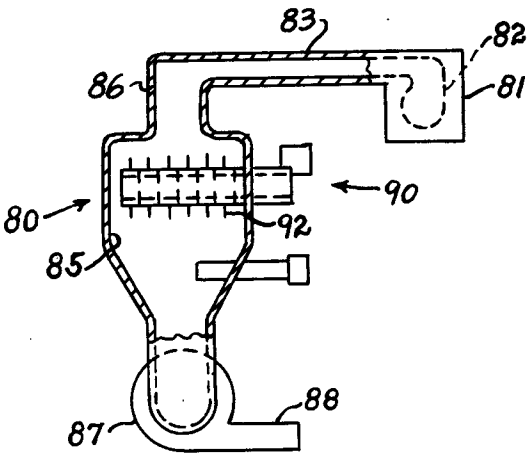
FIG. 3 is a schematic view illustrating an arrangement for preheating the residual oil.

In FIG. 3 an arrangement for heating the oil is schematically illustrated generally at 80 comprising an oil storage tank 81, and oil pump 82, a conduit 83 and an oil heating chamber 85 having an oil inlet 86. Means for heating the oil are indicated generally at 90. Heating means 90 may comprise one or more heating elements which extend into chamber 85 as indicated at 92 or the heating means may be located outside the oil preheating chamber and a heat transfer fluid circulated into the preheating chamber as shown in FIG. 2. An oil preheating outlet 88, an oil pump 87, and a conduit(s) are provided to transfer the preheated oil to the oil supply tube 10 in the burner.

If desired, any secondary combustion air may also be preheated before it enters the burner through the same or a separate preheating chamber, although such secondary combustion air preheating is not necessary for most applications.

If both the forced atomizing air and the forced secondary air enter the burner through a common burner entry point 132 (shown schematically in FIG. 4), then preheating of both the forced atomizing air and the forced secondary air is necessary for successfully burning preheated residual oil in small capacity forced atomizing air type burners (approximately 10 GPH maximum capacity), as there is no means of isolating atomizing air source from secondary air source.

Figure 4:
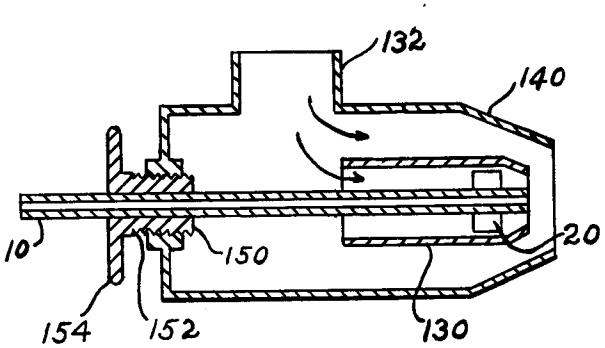
FIG. 4 is a sectional view of an alternative burner arrangement in which the atomizing air and the secondary air enter the burner through a common inlet.

In the embodiment shown in FIG. 4, both the atomizing air and the secondary combustion air, both of which have been preheated to the approximate temperature of the residual fuel oil entering tube 10, enter the burner through inlet 132. A portion of this preheated air enters the annulus 130, passes through swivel vanes 20 (optional) and atomizes the preheated oil as described herein above. The remaining preheated air enters the annulus 140 and provides secondary air to ensure complete combustion.

If desired, the ratio of atomizing air to secondary air may be controlled by a suitable control device indicated generally at 150 in FIG. 4. This device may comprise a threaded segment 152 which is integrally affixed to atomizing air conduit 130 by the oil tube 10. A handle 154 is provided for moving the oil tube 10 and with it atomizing air conduit 130 toward or away from the discharge end. The nearer the disk is to the discharge end the less air passes through the secondary air decreased size of annulus. If the atomizing conduit is moved to the left in FIG. 4, the secondary air opening annulus at the discharge end is greater and more air passes through the secondary air annulus.

In FIG. 1 an outer annulus 40 having an inlet 42 may be provided to introduce additional secondary air to insure complete combustion. This secondary air may or may not be preheated.

What is claimed is:

1. A method for successfully burning residual oil in small capacity forced atomizing air type burners, comprising:

providing a source of residual oil for introduction into the burner oil supply tube;

preheating external to the burner the residual oil to a temperature such that an oil viscosity of 90 to about 150 SSU when entering the burner is obtained; providing a source of atomizing air;

heating the said atomizing air to substantially the same temperature as said preheated residual oil;

introducing said preheated oil into a central oil conduit in a forced atomizing air type oil burner;

passing the residual oil through the central oil conduit and discharging the same from said oil conduit;

passing said preheated atomizing air through a concentric conduit surrounding said oil conduit and in heat exchange relation therewith to maintain the preheated residual oil in the central conduit at substantially the same temperature as it entered said central conduit;

and discharging said preheated air from said concentric conduit to atomize said preheated residual oil into spheres or droplets; whereby said residual oil spheres or droplets can be effectively volatilized, with subsequent successful combustion of residual oil.

2. A method according to claim 1 wherein the capacity of said burners is not above about 10 G.P.H.

3. A method according to claim 2 wherein the viscosity of the preheated oil when it enters the center conduit is from about 90 to about 120 SSU.

4. A method according to claim 2 wherein an additional source of non-preheated secondary air is introduced into and passes through an outer chamber which is concentric with said concentric atomizing air chamber, which provides additional air for complete combustion of said residual oil.

5. A method according to claim 1 wherein the procedure of preheating said ambient air and passing the same through said concentric atomizing air chamber is carried out prior to introducing the said preheated residual oil into said oil conduit; and subsequently introducing preheated residual oil into said preheated oil conduit; whereby the combustion process proceeds effectively upon initially introducing the preheated residual oil into the burner.

6. A method according to claim 1 wherein in addition to the atomizing air, secondary air is heated, which secondary air passes through an outer chamber concentric with said concentric atomizing air conduit and then provides air for complete combustion of the residual oil.

7. A method according to claim 6 wherein the atomizing air and secondary air are preheated in the same chamber.

8. A method according to claim 6 wherein the atomizing air and the secondary air enter the burner through the same inlet.

9. A method according to claim 3 wherein the atomizing air and the secondary air enter the burner through separate inlets.

10. A method according to claim 1 wherein said burner is a new burner.

11. A method according to claim 1 wherein burner is a used burner.

12. A method according to claim 1 wherein said atomizing air is preheated with a heat transfer fluid.

13. A method according to claim 1 wherein said atomizing air is preheated with a heating element.

14. A method according to claim 1 wherein the air temperature during preheating is automatically controlled.

15. A method according to claim 14 wherein the amount of atomizing air supplied to the burner is automatically controlled.

* * * * *